US006830477B2

(12) United States Patent
Vander Vorste et al.

(10) Patent No.: US 6,830,477 B2
(45) Date of Patent: Dec. 14, 2004

(54) NEMA-TYPE AC POWER OUTLET CONNECTORS

(75) Inventors: Michael Dwight Vander Vorste, Sioux Falls, SD (US); Peter S. Pulizzi, Fountain Valley, CA (US)

(73) Assignee: Pulizzi Engineering Inc., Santa Ana, CA (US)

( * ) Notice: Subject to any disclaimer, the term of this patent is extended or adjusted under 35 U.S.C. 154(b) by 17 days.

(21) Appl. No.: 10/039,625

(22) Filed: Oct. 19, 2001

(65) Prior Publication Data

US 2003/0077928 A1 Apr. 24, 2003

(51) Int. Cl.[7] ..... H01R 13/60
(52) U.S. Cl. ..... 439/535; 439/214
(58) Field of Search ..... 439/535, 214, 439/172

(56) References Cited

U.S. PATENT DOCUMENTS 6,220,880 B1 * 4/2001 Lee et al. ..... 439/535

OTHER PUBLICATIONS

IEC Connector Specification Sheets (2 pages) Power Dynamics, Inc. Catalog pp. 258, 259 Date undetermined.

IEC Multiple Connector Specification Sheets (2 pages) Power Dynamics, Inc. Catalog pp. 262, 263 date undetermined.

Multiple Outlet Connector IEC320–C13 Qualtek AC Receptacles–Power outlets dated Nov. 20, 2000.

Power Distribution, Control and Remote Reboot Systems Specification Sheets Pulizzi Engineering, Inc. Web Site dated Jun. 9, 2001 (2 pages).

* cited by examiner

*Primary Examiner*—Tho D. Ta
(74) *Attorney, Agent, or Firm*—Howard R. Lambert

(57) ABSTRACT

A new NEMA-style AC power outlet connector includes a body portion and a shoulder portion, the body portion is configured for fitting into a standard cutout for a conventional IEC AC power outlet connector.

5 Claims, 7 Drawing Sheets

NEMA-TYPE AC POWER OUTLET CONNECTORS

BACKGROUND OF THE INVENTION

1. Field of the Invention

The present invention relates generally to the field of electrical (including electronic) equipment, more particularly to electrical components, and still more particularly to NEMA (National Electrical Manufacturers Association) and IEC (International Electrotechnical Commission) electrical outlet connectors.

2. Background Discussion

Known types of AC electrical power output equipment, including power supplies, power distributors and power controllers, are configured for providing electrical power to external electrical equipment, such as computers, printers and disc drives. To accomplish this, the AC electrical power output equipment has installed in the equipment enclosures one or more AC electrical outlet connectors into which can be plugged external AC electrical equipment.

These electrical equipment AC outlet connectors are of two different configurations, depending upon the country in which the equipment is used or marketed for use. AC Electrical power output equipment to be used in the United States and such other countries as Canada, Mexico, South Korea, Taiwan, and Central and South American countries that have some links to the United States, require U.S.-type NEMA AC power outlet connectors. Otherwise identical AC electrical power equipment to be used in other countries, such as the European countries, including Germany and England, require the "foreign"-type IEC AC power outlet connectors.

Conveniently, from an equipment manufacturing perspective, the IEC and NEMA AC power outlet connectors are typically of the front mounting type and are preferably of the snap-in type.

Unfortunately, the designs of NEMA and IEC AC power outlet connectors were not coordinated and the two types of AC power outlet connectors have different body sizes, the NEMA power outlet connector body being smaller than the IEC power outlet connector body. Accordingly, the two types of power outlet connectors require two different sizes of enclosure cutouts into which the outlet connectors are received. Furthermore, the flat, electrical connector terminals of the NEMA power outlet connectors are more narrow than those of the IEC power outlet connectors so that NEMA wiring harnesses have to be different than IEC wiring harnesses.

As a result of these differences between NEMA and IEC power outlet connectors, AC electrical power output equipment manufacturers with worldwide sales are required to produce two alternative, but otherwise the same, AC power output equipment versions-one version having NEMA AC outlet connectors and associated enclosure cutouts and NEMA wiring harnesses for NEMA-country users and the other version having IEC AC output connectors and associated enclosure cutouts and IEC wiring harnesses for IEC-country users.

By way of illustrative examples of this situation, and as more particularly described below, FIG. 1 depicts a conventional IEC-country AC power controller having several IEC type C13 (250 VAC, 10 ampere) AC power outlet connectors (having a three pin receptacle arrangement) and FIG. 3 depicts a corresponding NEMA-country AC power controller having several NEMA type 5-15R (125 VAC, 15 ampere) AC power outlet connectors (having a three pin receptacle identical to those of common U.S. power company AC wall outlets.

The necessity of manufacturing two versions of each type of AC power output equipment sold worldwide requires the making and inventorying of two different equipment enclosures—one with IEC power outlet connector cutouts and one with NEMA power outlet connector cutouts. In addition, because the IEC and NEMA power outlet connectors have wire connection terminals of different widths, two different wiring harnesses are required.

The result is that two different equipment enclosures and two different wiring harnesses have been required to be made and inventoried in order to manufacture IEC and NEMA versions of the same AC power output equipment, even though the equipment configuration, including components and printed circuit cards, controls and functional operation of both versions are otherwise identical.

This need for alternative equipment enclosures and wiring harnesses significantly increases the cost of the electrical power equipment for the worldwide market and puts relatively moderate-volume equipment manufacturers at a competitive disadvantage as compared to large-volume manufacturers.

A principal objective of the present invention is therefore to provide NEMA-style AC power outlet connectors that are the same size as corresponding IEC AC power outlet connectors and have the same terminal size as those of the corresponding C13 connectors so that the same equipment enclosures and wiring harnesses can be used for both IEC and NEMA versions of the same AC power output equipment.

SUMMARY OF THE INVENTION

In accordance with the present invention there is provided a new NEMA-style AC power outlet connector comprising a body portion and a shoulder portion, said body portion being configured for fitting into a standard cutout for a conventional IEC AC power outlet connector.

The IEC AC power outlet connector may be an IEC C13 AC power outlet connector having a standard cutout that is rectangular in shape with a height of about 1.28 inches and a width of about 0.98 inch, the shoulder portion having a height of about 1.375 inches and a width of about 1.0625 inches, and the body portion including at least one opposing pair of elastic spring clips for retaining the new NEMA-style AC power outlet connector snapped into the standard cutout. In which case, the new NEMA-style AC power outlet connector is selected from the group consisting of NEMA 5-15R, 125 VAC, 15 amperes; NEMA 6-15R, 250 VAC, 15 amperes; NEMA 5-20R, 125 VAC, 20 amperes; and NEMA 6-20R, 250 VAC, 20 amperes, AC power outlet connectors.

Alternatively, the IEC AC power outlet connector is an IEC C19, 250 VAC, 16 ampere, AC power outlet connector for which the standard cutout is rectangular in shape, having a height of about 1.180 inches and a width of about 1.496 inches, the shoulder portion having a height of about 1.339 inches and a width of about 2.165 inches and includes a pair of screw mounting holes spaced apart a distance equal to 1.772 inches. Accordingly, the new NEMA-style AC power outlet connector is selected from the group consisting of NEMA 5-20R, 125 VAC, 20 amperes; and NEMA 6-20R, 250 VAC, 20 amperes, AC power outlet connectors.

According to an embodiment of the invention, a new NEMA-style AC power outlet connector comprises a body portion and a shoulder portion, the body portion being configured for snapping into a standard cutout for a conventional IEC C13, 250 VAC, 10 ampere, AC power outlet connector, the standard cutout being rectangular in shape and having a height of about 1.28 inches and a width of about 0.98 inch, the shoulder portion having a height of about 1.375 inches and a width of about 1.0625 inches. Preferably, the body portion includes at least one opposing pair of elastic spring clips for retaining the new NEMA-style AC power outlet connector in the standard cutout and also includes three flat wiring connection terminals extending from the body portion, each of the flat terminals having a width of 0.25 inch. Alternatively, the body portion includes three pin wiring connection terminals extending from the body portion for enabling said new NEMA-style AC power outlet connector to be mounted to a printed circuit card, each of the pin terminals having a diameter of about 0.06 inch.

The new NEMA-style AC power outlet connector may be configured as a new NEMA 5-15R, 125 VAC, 15 ampere, AC power outlet connector; as a new NEMA 6-15R, 250 VAC, 15 ampere, AC power outlet connector; as a new NEMA 5-20R, 125 VAC, 20 ampere, AC power outlet connector; or as a new NEMA 6-20R, 250 VAC, 20 ampere, AC power outlet connector.

In accordance with another embodiment of the invention, a new NEMA-style AC power outlet connector comprising a body portion and a shoulder portion, the body portion being configured for fitting into a standard cutout for a conventional IEC C19, 250 VAC, 16 ampere, AC power outlet connector, the standard cutout being rectangular in shape and having a height of about 1.180 inches and a width of about 1.490 inches, said shoulder portion having a height of about 1.339 inches and a width of about 2.165 inches and includes a pair of screw mounting holes spaced apart a distance equal to 1.772 inches.

The new NEMA-style AC power outlet connector may be configured as a new NEMA 5-20R, 125 VAC, 20 ampere, AC power outlet connector or as a new NEMA 6-20R, 250 VAC, 20 ampere, AC power outlet connector, and may be configured in size and shape to the IEC C19 AC power outlet connector or may be sized and shaped to snap fit into the IEC C19 mounting cutout.

In accordance with another embodiment of the present invention, a new NEMA AC power outlet connector module is formed from n new NEMA AC power outlet connectors, the new NEMA AC power outlet connector module having a composite body portion configured for fitting into a standard cutout for a corresponding IEC AC power outlet connector module formed from n IEC AC power outlet connectors. Preferably the number n is equal to 2, 3, 4, 5 or 6.

Also preferably, the IEC AC power outlet connector module is formed from n IEC C13 AC power outlet connectors, and the new NEMA-style AC power outlet connectors for the new NEMA-style AC power outlet connector module are selected from the group consisting of NEMA 5-15R, 125 VAC, 15 amperes; NEMA 6-15R, 250 VAC, 15 amperes; NEMA 5-20R, 125 VAC, 20 amperes; and NEMA 6-20R, 250 VAC, 20 amperes, AC power outlet connectors.

BRIEF DESCRIPTION OF THE DRAWINGS

The present invention can be more readily understood by a consideration of the following detailed description when taken in conjunction with the accompanying drawings, in which:

FIG. 6 shows two perspective views of a new NEMA 5-15R AC power outlet connector in accordance with the present invention.

In the various FIGS., the same elements and features are given the same reference numbers and corresponding elements and features are given the same reference numbers followed by an "a", "b" and so forth except as may otherwise be disclosed in the following DESCRIPTION.

DESCRIPTION OF THE PREFERRED EMBODIMENT

Figure 1:
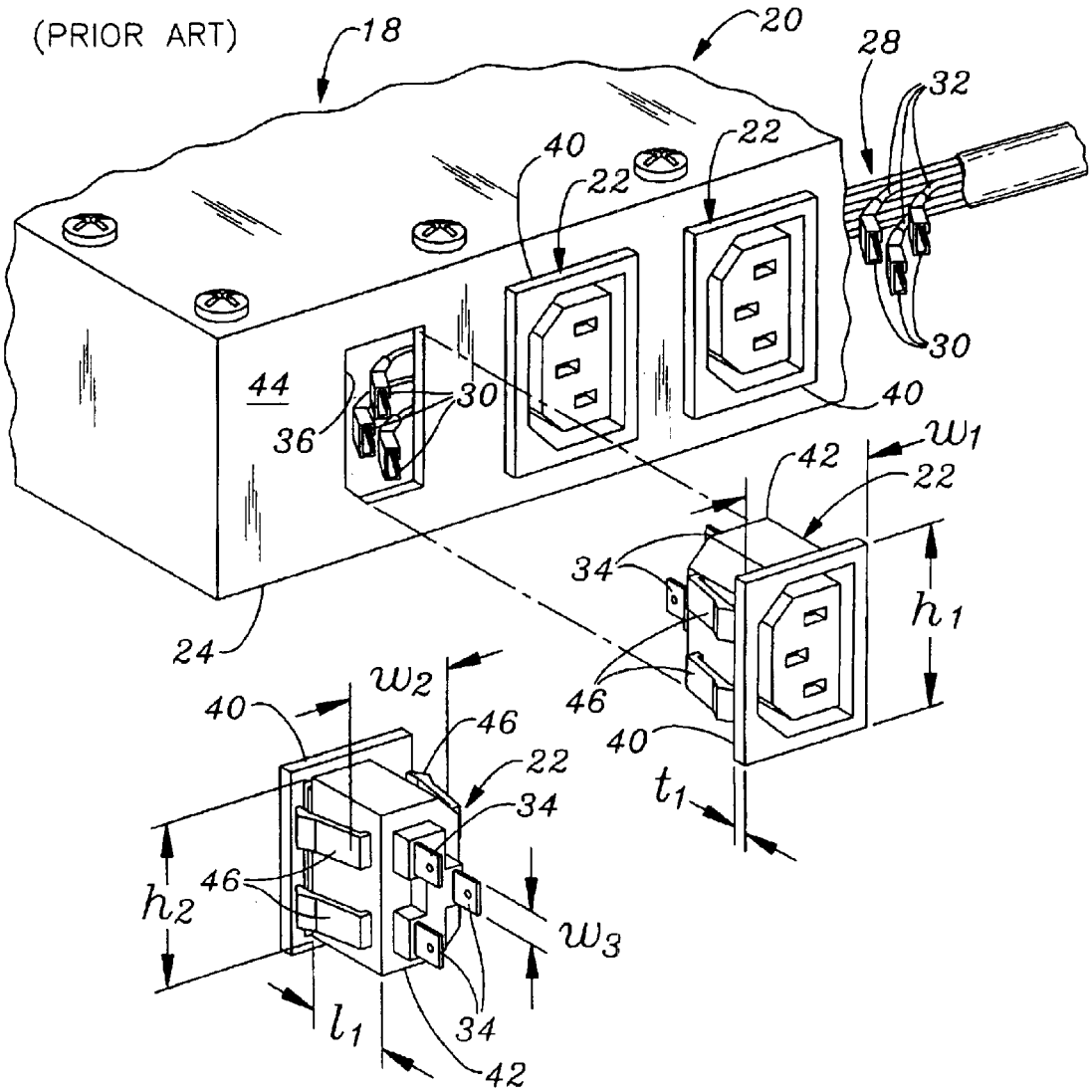
Fig. 1 (PRIOR ART)
FIG. 1 is a partial perspective drawing depicting a representative IEC-type AC power controller having a row of conventional snap-in IEC C13 (250 VAC, 10 ampere) AC power outlet connectors front mounted in an enclosure wall, showing portions of an associated electrical wiring harness, showing an enclosure wall cutout for one of the IEC C13 power outlet connectors, and showing, in perspective, front and rear views of an uninstalled IEC C13 power outlet connector.

FIG. 1 depicts a partial enclosure 18 of a representative, conventional 10 ampere output IEC-type AC power output controller 20. Enclosure 18 is shown for illustrative purposes as that of a model IPC 3401 AC power output controller manufactured by Pulizzi Engineering Inc. of Santa Ana, Calif.

As shown, AC power output controller 20 is constructed having a row of known (off-the-shelf) snap-in, three pin, grounded female IEC type C13 (250 VAC, 10 ampere) power outlet connectors 22, made of a hard, insulating thermoplastic material, front mounted in an enclosure wall 24. Preferably, enclosure wall 24 is constructed from 16 gauge (0.06 inch) sheet metal.

An associated IEC connector wiring harness 28 (only portions of which are shown) is installed in enclosure 18 behind wall 24 adjacent inside regions of IEC outlet connectors 22. Sets of three end connectors 30 on wires 32 that comprise wiring harness 28 are provided for making slip-on electrical connection to corresponding flat terminals 34 of each of IEC outlet connectors 22.

An uninstalled one of IEC C13 AC power outlet connectors 22 is shown positioned for snapping into a standard IEC C13 outlet connector receiving cutout 36 (see also FIG. 2) in enclosure wall 24.

IEC C13 AC power outlet connector 22 comprises a shoulder or flange portion 40 and a body portion 42. Connector shoulder portion 40 is rectangular in outline and sized to abut an exterior surface 44 of enclosure wall 24 when connector body portion 42 is snapped into cutout 36. Shoulder portion 40 has a height, $h_1$, of about 1.375 inches, a width, $w_1$ of about 1.062 inches and a thickness, $t_1$, of about 0.09 inch.

Connector body portion 42 includes opposing pairs of flexible spring retaining clips 46 for retaining installed IEC C13 power outlet connector 22 in enclosure wall cutout 36. In transverse cross section connector body 42 is generally D-shaped, having an overall height, $h_2$, of about 1.26 inches, an overall width, $w_2$, of about 0.96 inch and a length, $l_1$, of about 0.625 inch. Three flat "spade" terminal connectors 34 project outwardly from connector body in an axial direction, each having a preferred width, $w_3$, of about 0.25 inch, but may alternatively may be about 0.187 inch.

Enclosure wall cutout 36 (FIG. 2), with which the present invention is concerned, is made to securely receive, in a close-fitting relationship, body portion 42 of IEC C13 AC power outlet connector 22. Cutout 36 is rectangular in shape and (allowing about 0.020 clearance for connector body portion 42) has a preferred height, $h_3$, of 1.280 inches and a preferred width, $w_4$, of 0.980 inch.

Figure 2:
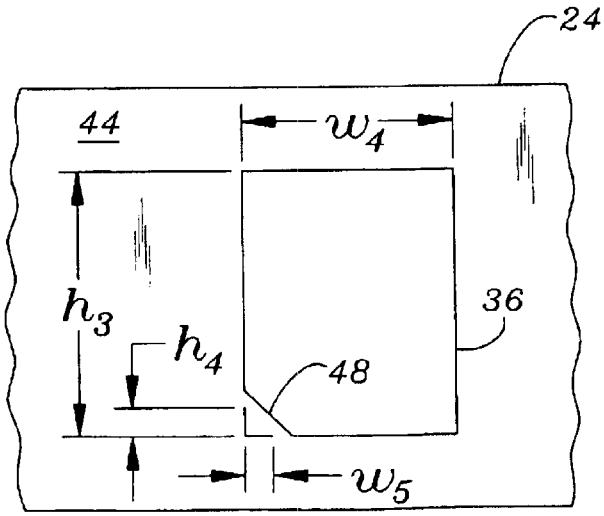
Fig. 2 (PRIOR ART)
FIG. 2 is an enlarged view drawing of the IEC C13 AC power outlet connector enclosure wall cutout of FIG. 1, showing details thereof.

Preferably as shown in FIG. 2, but not necessarily, cutout 36 is beveled at about 45 degrees at one corner region, for example, a lower left-hand corner region 48, to ensure a predetermined orientation of connector 22 upon its installation in the cutout (recalling that connector body 42 is D-shaped in transverse cross section). Corner region 48 is defined by a height, $h_4$, of about 0.20 inch and a width, $w_5$, of about 0.20 inch.

Figure 3:
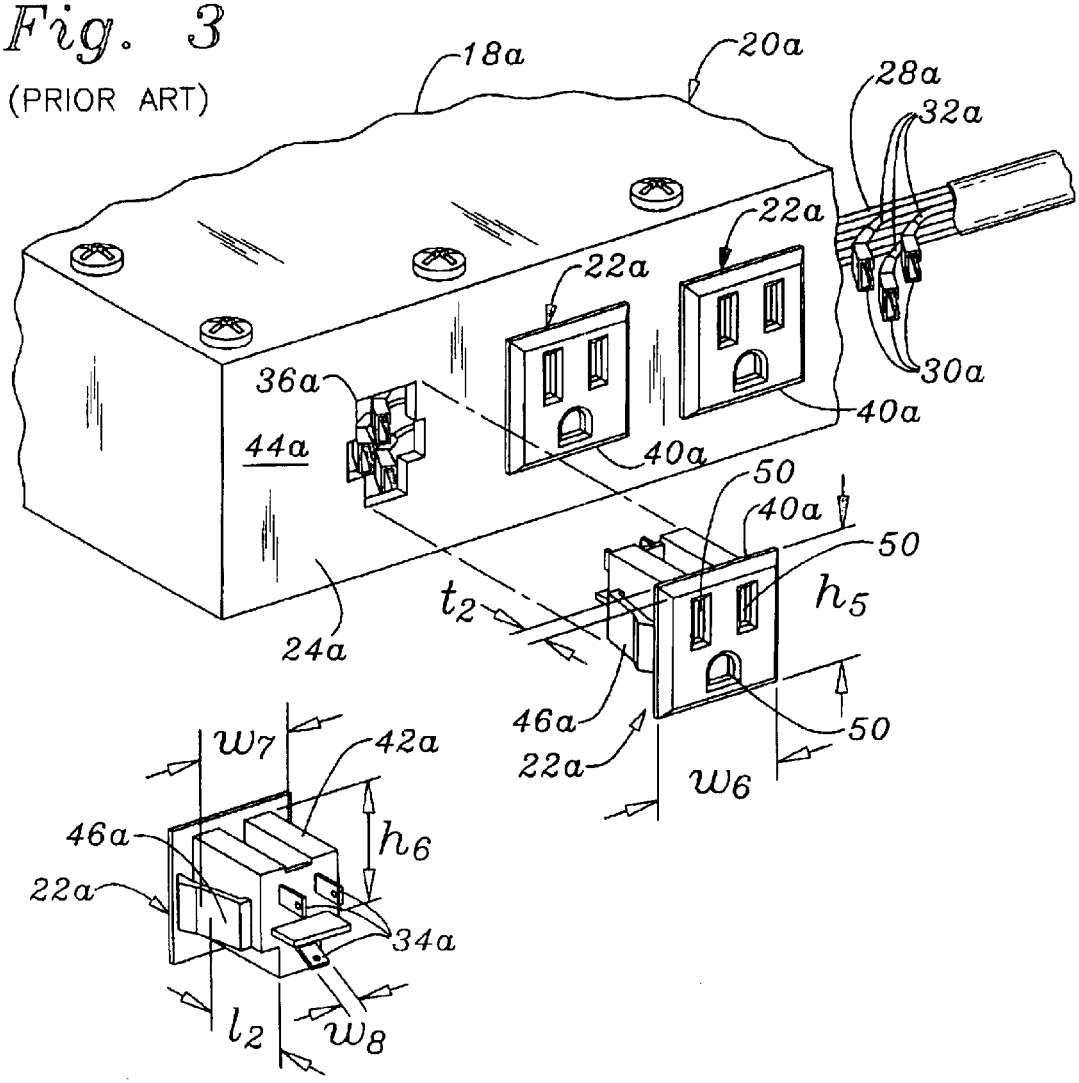
Fig. 3 (PRIOR ART)
FIG. 3 is a partial perspective drawing depicting a representative NEMA-type AC power controller (corresponding to the IEC-type AC power controller depicted in FIG. 1) having a row of conventional snap-in NEMA type 5-15R (125 VAC, 15 ampere) AC power outlet connectors front mounted in an enclosure wall, showing portions of an associated electrical wiring harness, showing an enclosure wall cutout for one of the NEMA 5-15R power outlet connectors, and showing, in perspective, front and rear views of an uninstalled NEMA 5-15R AC power outlet connectors.

By way of further illustrating the prior art, FIG. 3 depicts a partial enclosure 18*a* of a representative, conventional NEMA-type AC power controller 20*a* that corresponds to above-described IEC-type AC power controller 20. Enclosure 18*a* is shown for illustrative purposes as that of a model IPC 3402 AC power controller manufactured by Pulizzi Engineering Inc. of Santa Ana, Calif.

As shown, AC power controller 20*a* is constructed having a row of known (off-the-shelf) snap-in, three pin, grounded female NEMA type 5-15R power outlet connectors (receptacles) 22*a*, made of a hard insulating thermoplastic material, front mounted in an enclosure wall 24*a*. Since NEMA5-15 connectors 22*a* are rated for a 125 VAC and 15 ampere output, equipment 20 and 20*a* are internally configured for automatically selecting between 250 VAC and 125 VAC outputs.

An associated NEMA connector wiring harness 28*a* (only portions of which are shown) is installed in enclosure 18*a* behind wall 24*a* adjacent inside regions of NEMA outlet connectors 22*a*. Sets of three end connectors 30*a* on wires 32*a* that comprise wiring harness 28 are provided for making slip-on electrical connection to corresponding flat terminals 34*a* of each of NEMA outlet connectors 22*a*. Except for the size of end connectors 30*a*, NEMA wiring harness 28*a* is the same as above-described IEC wiring harness 28.

Figure 4:
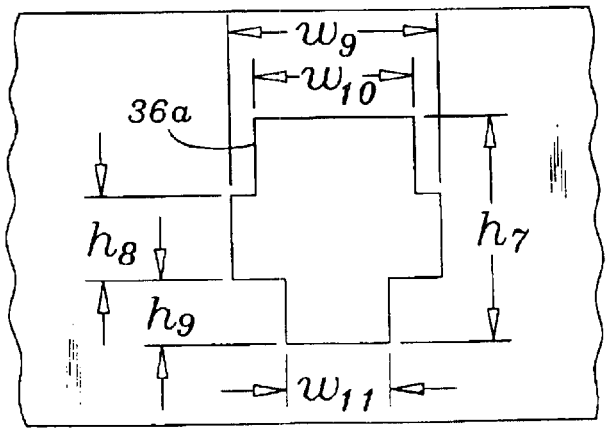
Fig. 4 (PRIOR ART)
FIG. 4 is an enlarged view drawing of the NEMA 5-15R AC power outlet connector enclosure wall cutout of FIG. 3, showing details thereof.

An uninstalled one of NEMA 5-15R power outlet connectors 22*a* is shown positioned for snapping into a standard NEMA 5-15R outlet connector receiving cutout 36*a* (see also FIG. 4) in enclosure wall 24*a*. Except for the size of cutouts 36*a*, NEMA enclosure 18*a* is preferably identical to above-described IEC enclosure 18.

NEMA 5-15R AC power outlet connector 22*a* comprises a shoulder or flange portion 40*a* and a body portion 42*a*. Connector shoulder portion 40*a* is square in outline and sized to abut an exterior surface 44*a* of enclosure wall 24*a* when connector body portion 42*a* is snapped into cutout 36*a*. Shoulder portion has a height, $h_5$, of about 1.0 inches, a width, $w_6$, of about 1.0 inches and a thickness, $t_2$, of about 0.09 inch.

Connector body portion 42*a* includes an opposing pair of spring retaining clips 46*a* which retain installed power outlet connector 22*a* in the enclosure wall cutout 36*a*. In transverse cross section connector body 42*a* is generally in the shape of a thick, inverted T, having a length, $l_2$, of about 0.875 inch, an overall height, $h_6$, of about 0.85 inch, an overall width, $w_7$, of about 1.132 inches (to outsides of spring retaining clips 46*a*) and a length, $l_2$, of about 0.625. Three flat quick disconnect terminals, which project outwardly from connector body 42*a* in a generally axial direction, each have a width, $w_8$, of about 0.187 inch and are internally connected to three standard plug-receiving openings 50.

Enclosure wall cutout 36*a* (FIG. 4) is made to securely receive, with about 0.02 inch total edge clearance, body portion 42*a* of NEMA 5-15R power outlet connector 22A. As such, cutout 36*a* is generally cross-shaped, having a preferred overall height, $h_7$, of 0.870 inch and a preferred overall width, $w_9$, of about 0.98 inch. As further shown in FIG. 4, cutout 36*a* has intermediate widths, $w_{10}$ and $w_{11}$, that are respectively 0.709 inch and 0.358 inch, and intermediate heights, $h_6$ and $h_7$, of 0.417 inch and 0.227 inch, respectively. It is evident that the cross-shape of cutout 36*a* that corresponds to the cross-shape of connector body 42*a* ensures correct orientation of connector 22*a* upon its installation in the cutout.

From a comparison of the dimensions of IEC C13 AC power outlet connector body portion 42 (FIG. 1) and associated cutout 36 (FIG. 2) with those of NEMA 5-15R AC power output connector body portion 42*a* (FIG. 3) and associated cutout 36*a* (FIG. 4), NEMA 5-15R power outlet connectors 22*a* are too small to fit closely into the IEC cutouts. Moreover, quick disconnect terminals 32*a* of NEMA power output connectors 22*a* are smaller than corresponding quick disconnect terminals 32 of IEC connectors 22 and IEC C13 wiring harness 28 cannot be used with the NEMA 5-15R connectors because the IEC C13 wiring harness end connectors 30 are too large for the NEMA quick disconnect terminals 34*a*. Consequently, as above stated, different enclosures 18 and 18*a* having different cutouts 36 and 36*a* and different wiring harnesses 28 and 28*a* have heretofore been required for IEC and NEMA versions (20 and 20*a*) of the otherwise "same" piece of AC power output equipment.

Figure 5:
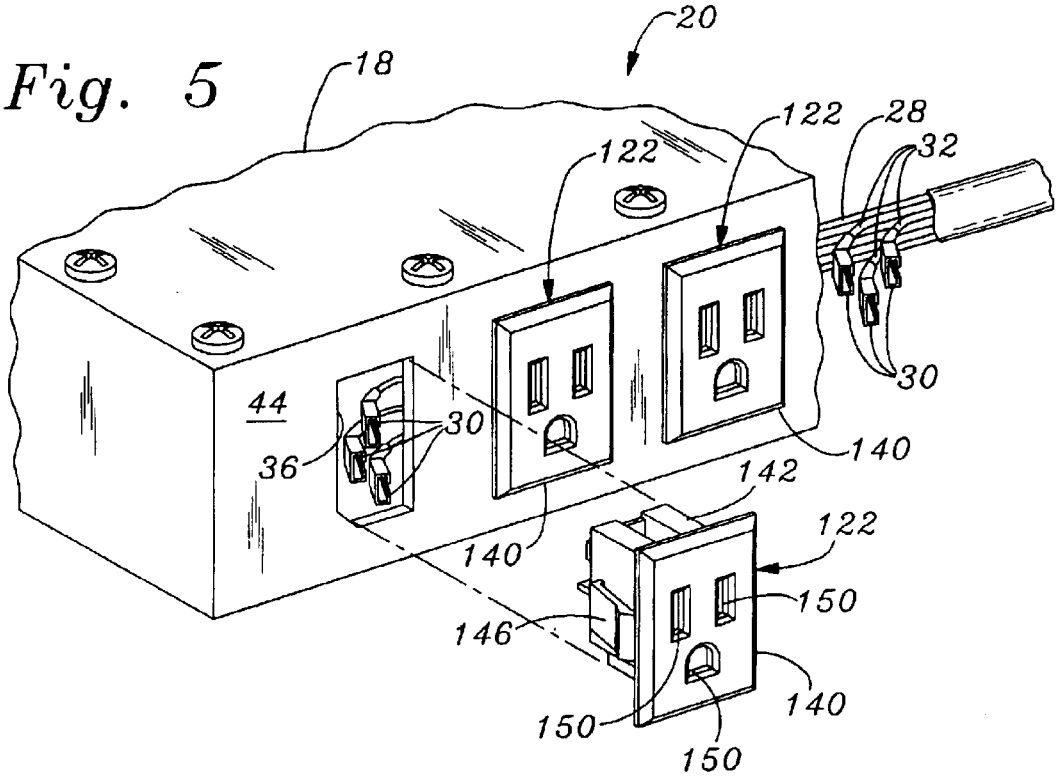
FIG. 5 is a partial perspective drawing depicting a representative new NEMA-type AC power controller (corresponding directly to the IEC-type AC power controller depicted in FIG. 1) having a row of new NEMA type 5-15R AC power outlet connectors (in accordance with the present invention) front mounted in an enclosure wall of the power controller, showing portions of an associated electrical wiring harness, showing an IEC C13 enclosure wall cutout for one of the new NEMA 5-15R power outlet connectors, and showing, in perspective, a front view of an uninstalled new NEMA 5-15R power outlet connector.
Figure 6A:
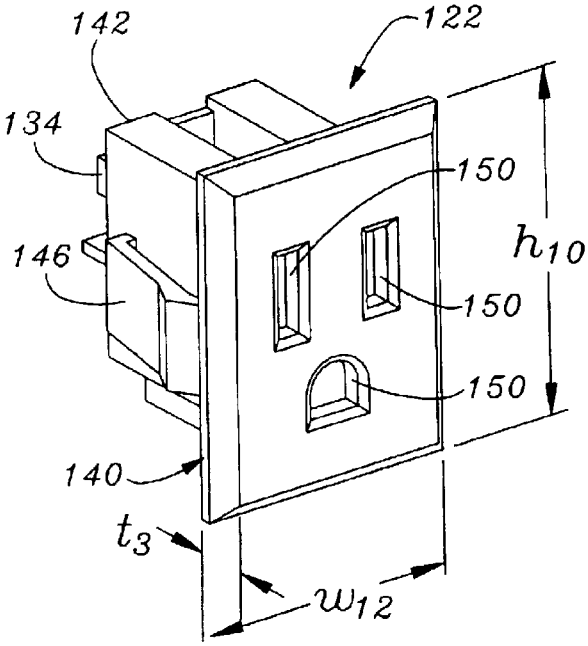
FIG. 6A is an enlarged front perspective view of the new NEMA 5-15R AC power outlet connector showing features of the connector shoulder.
Figure 6B:
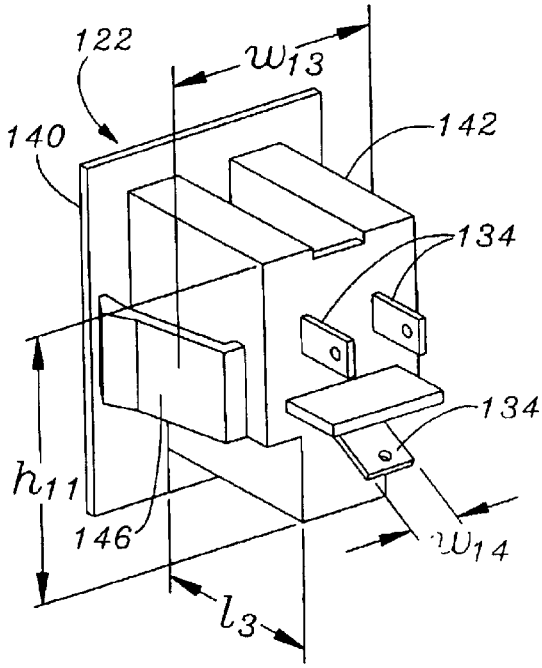
FIG. 6B is an enlarged rear perspective view of the new NEMA 5-15R connector showing features of the connector body and showing three flat electrical connection terminals for accepting quick disconnect slip-on electrical connectors associated with a wiring harness.

New NEMA 5-15R AC Power Outlet Connector of FIGS. 5, 6A and 6B:

The present inventors have importantly determined that the expense of stocking and manufacturing such different IEC and NEMA versions of the same AC power output equipment can be significantly reduced by making a new, larger female NEMA 5-15R AC power outlet connector 122 (FIGS. 5 and 6 ).

Thus, in accordance with the present invention, new NEMA 5-15R AC power outlet connector 122 is formed having a body portion 142 that will fit closely into IEC C13 cutout 36 in enclosure 18. In addition, new NEMA 5-15R AC power outlet connector 122 is made having three quick disconnect terminals 134 (FIG. 6B) the same size as terminals 34 of IEC C13 AC power outlet connector 22 (FIG. 1) so that IEC wiring harness 28 can be used with the new NEMA 5-15R connector.

As a result, above-described enclosure 18 (with cutouts 36) and wiring harness 28 (with end connectors 30 ) (FIG. 1) can now be used for both IEC and NEMA versions of the same AC power output equipment, with IEC C13 AC outlet connectors 22 being installed in enclosure 18 and connected to harness 28 for IEC-country power output equipment and new NEMA 5-15R AC power outlet connectors 122 being installed in enclosure 18 and connected to harness 28 for NEMA-country power output equipment.

As shown in FIGS. 5 and 6A, new NEMA 5-15R AC power outlet connectors 122 have a grounded plug-in configuration of three plug-receiving openings 150 identical to that of conventional NEMA AC power outlet connectors 22*a* (FIG. 3). As a result, AC power output equipment using new NEMA 5-15R connectors 122 will meet all requirements of the same equipment using conventional NEMA 5-15R connectors 22*a*.

New NEMA 5-15R AC power outlet connector 122 is formed from a high dielectric thermoplastic material and, as shown in FIGS. 5 and 6, comprises a rectangular shoulder portion 140 and a generally cross-shaped body portion 142. Connector shoulder portion 140 (FIG. 6A) is preferably the same size as shoulder portion 40 (FIG. 1) of IEC C13 connector 22 so as likewise to abut enclosure wall surface 44 around edges of cutout 36. Thus, connector shoulder portion 142 has a preferred height, $h_{10}$, of about 1.375 inches, a preferred width, $w_{12}$, of about 1.062 inches and a preferred thickness, $t_3$, of about 0.09 inches Connector body portion 142, which includes an opposing pair of spring retaining clips 146 and three projecting connection terminals 134, is generally cross-shaped in transverse cross section (when considering the retaining clips) and is similar in shape to, but larger than, above-described NEMA body portion 42*a* (FIG. 3). Body portion 142 is sized, in transverse cross section, to fit closely into IEC C13 cutout 36 (FIG. 2) with a total clearance of only about 0.02 inch, thereby having a preferred overall height, $h_{11}$, of about 1.260 inches and a preferred overall width, $w_{13}$, (including retaining clips 146 ) of about 0.960 inch. Connector body portion 142 has a preferred length, $l_3$, of about 0.625 inch.

Each of the three flat quick disconnect terminals 134 extending from connector body portion 142 has a width, $w_{14}$ of 0.250 inch or of 0.187 inch for connection by IEC C13 wiring harness end connections 30 (FIG. 1), according to the size of the end connections. Terminals 134 are preferably arranged in the same pattern as terminals 34*a* of new NEMA AC power outlet connector 22*a* (FIG. 3).

Figure 7A:
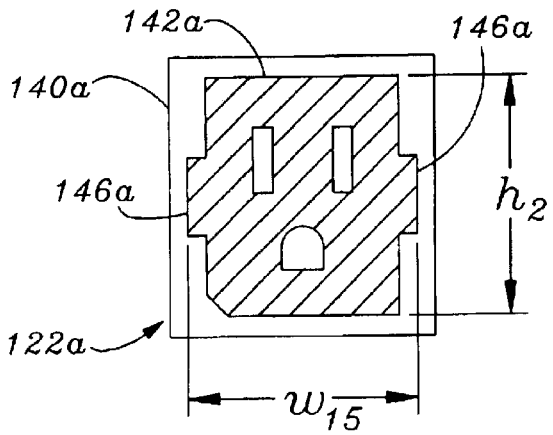
FIG. 7 shows two variation transverse cross sections of a new NEMA 5-15R AC power outlet connector, FIG. 7A showing a generally rectangular transverse cross sectional connector body shape, and FIG. 7B showing a generally D-shaped transverse cross sectional connector body shape.
Figure 7B:
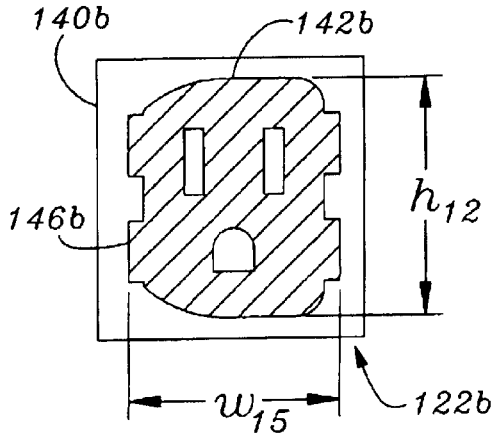

First and Second Variations, New NEMA 5-15R AC Power Outlet Connectors of FIGS. 7A and 7B:

It is to be understood that various different body portion transverse cross sectional shapes may be used to provide variations of above-described new NEMA 5-15R AC power outlet connector 122, the only requirement being that each such body portion variation fits closely into IEC C13 connector cutout 36.

By way of illustrative example, FIG. 7A shows a first variation new NEMA 5-15R AC power outlet connector 122*a* in accordance with the present invention. A connector body portion 142*a* is shown to be generally rectangular in transverse cross section (neglecting an opposing pair of retaining clips 146*a*), with the lower left hand corner beveled to fit inside angled corner 48 of IEC C13 connector cutout 36 (FIG. 2).

Shown in FIG. 7B by way of further illustrative example is a second variation new NEMA 5-15R AC power outlet connector 122*b* in accordance with the present invention. A connector body portion 142*b* is shown to be generally D-shaped in transverse cross section (neglecting two opposing pairs of retaining clips 146*b*). As such, connector body portion 142*b* is formed to resemble in both shape and size IEC C13 connector body portion 42 (FIG. 1) for snapping into connector cutout 36.

Both connector body variations 142*a* and 142*b* have overall transverse cross section heights, $h_7$, of about 1.260 inches and overall widths, $w_{11}$, (including retaining clips 146*a* and 146*b*) of about 0.960 inch.

Other than the transverse cross sectional shape of connector body portions 142*a* and 142*b*, new NEMA 5-15R AC power outlet connector variations 122*a* and 122*b* are preferably identical to above-described new NEMA 5-15R AC power outlet connector 122. It will, of course, be appreciated that new NEMA 5-15R AC outlet connector body portions with other cross sectional shapes are also within the scope of the present invention as long as the connectors fit closely in IEC connector cutout 36.

Figure 8:
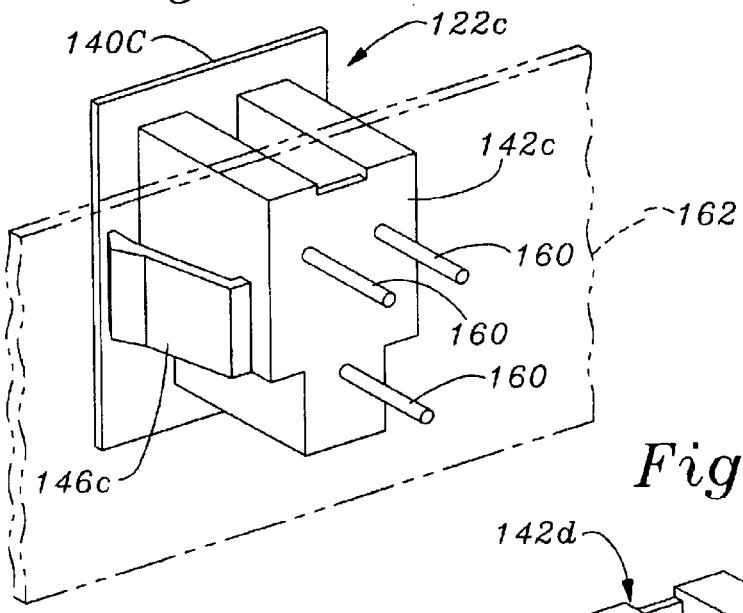
FIG. 8 is a rear perspective view of a variation new NEMA 5-15R AC power outlet connector similar to FIG. 6B, except showing three pin-type electrical connection terminals enabling the power outlet connector to be mounted on a printed circuit card.

Third Variation New NEMA 5-15R AC Power Outlet Connector of FIG. 8:

As described above, known IEC C13 and NEMA 5-15R AC power outlet connectors 20 and 22*a* as well as new NEMA 5-15R AC power outlet connectors 122, 122*a* and 122*b* are configured having flat quick disconnect terminals 34, 34*a* or 134, as the case may be, by means of which electrical connections are made by wiring harnesses 28 or 28*a*.

However, some IEC-type AC power output equipment (not shown) may be assembled using IEC C13 AC power outlet connectors having pin-type (instead of flat) connection terminals to enable soldering the power outlet connectors to a conventional printed circuit card (circuit board) in a well known manner.

For such equipment assemblies, above-described IEC C13 connector cutout 36 (FIG. 2), for example, in wall 24 of enclosure 18 (FIG. 1), would still be used for front snap-in mounting of the pin-terminal IEC C13 AC power outlet connectors, but wiring harness 28 would be replaced by a printed circuit card (not shown) that might have soldered thereto various other electrical components.

A pin terminal-type, third variation new NEMA 5-15R AC power outlet connector 122*c*, according to the present invention, that corresponds to a pin terminal type of IEC C13 AC power outlet connector is therefore shown in FIG. 8. Third variation new NEMA 5-15R AC power outlet connectors 122*c* is formed having a shoulder portion 140*c* and a body portion 142*c*. Shoulder portion 140*c* is shaped and sized as shown in FIG. 6A for shoulder portion 140 of new NEMA power outlet connector 122. Connector body portion 142*c* is shown, by way of illustrative example, identical to body portion 142 of new NEMA power outlet connector 122 (FIG. 6B), except that the three flat connection terminals 134 extending from connector body portion 142 are replaced by three pin terminals 160, each having a diameter, $d_1$, of about 0.06 inch. Shown outlined in phantom lines in FIG. 8 is a region of an exemplary printed circuit card 162 to which pin terminals 160 may be solder attached.

Although pin terminals 160 are depicted in FIG. 8 as being straight, they may alternatively be bent over at right angles or to extend axially from lower region of body portion 142*c* to match the pin terminal arrangement of the corresponding pin terminal type IEC C13 connector. In the event, however, that pin terminals 160 of variation NEMA 5-15R AC power outlet connector 122*c* are not in the same mounting pattern as those of the corresponding pin terminal type of IEC C13 connector, accommodation for two different terminal pin patterns can be provided by forming parallel sets of terminal pin receiving holes (not shown) on printed circuit card 162.

It will be appreciated that body portion 142*c* of pin terminal-type third variation new NEMA 5-15R AC power outlet connector 122*c* may alternatively be shaped in transverse cross section as shown in FIG. 7A for body portion 140*a* of first variation new NEMA 5-15R AC power outlet connector 122*a* or as shown in FIG. 7B for body portion 142*b* of second variation new NEMA 5-15R AC power outlet connector 122*b* or in any other cross sectional shape fitting closely in IEC C13 cutout 36.

Figure 9:
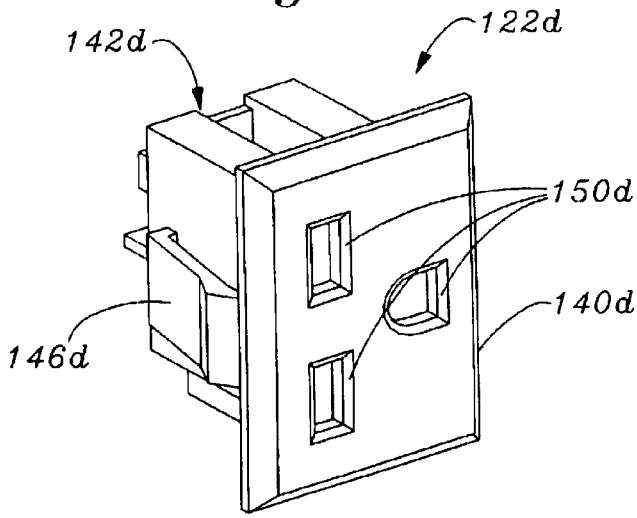
FIG. 9 is a front perspective view, similar to FIG. 6A, of a new NEMA 6-15R AC power outlet connector, showing the standard 250 VAC, 15 ampere arrangement of the three pin receiving openings.

New NEMA 6-15R AC Power Outlet Connector of FIG. 9:

Shown in FIG. 9 is a new NEMA 6-15R AC power outlet connector (receptacle) 122*d*, in accordance with the present invention, that is rated for a 250 VAC, 15 ampere output but is shaped to fit closely into IEC C13 connector cutout 36 (FIG. 2) as may sometimes be desirable so the same enclosure 18 can be used.

As shown, new NEMA 6-15R AC power outlet connector 122*d* is formed having a shoulder portion 140*d* shaped and sized the same as shoulder portion 140 of new NEMA 5-15R power outlet connector 122 and a body portion 142*d* shaped and sized the same as body portion 142 (FIG. 6B) of new NEMA 5-15R AC power outlet connector 122.

Thus, new NEMA 6-15R connector 122*d* may be identical to above-described new NEMA 5-15R connector 122 except for the standard 250 VAC, 15 ampere arrangement of three plug inlets 150*d* in body portion 142*d* for receiving a corresponding standard 6-15P plug (not shown) that is provided in place of the standard 125 VAC, 15 ampere arrangement (shown in FIG. 6A) of the three plug inlets 150 of new NEMA 5-15R AC power outlet connector 122.

It will be appreciated that body portion 142*d* of new NEMA 6-15R AC power outlet connector 122*d* may alternatively be shaped and sized in transverse cross section as depicted for body portion 142*a* of first variation NEMA 5-15R connector 122*a* (FIG. 7A) or as depicted for body portion 142*b* of second variation NEMA 5-15R connector 122*b* (FIG. 7B).

Body portion 142*d* of new NEMA 6-15R connector 122*d* is preferably formed having three spade terminals as shown for terminals 134 of new NEMA 5-15R AC power outlet connector 122 in FIG. 6B, but may alternatively be formed having three pin terminals as shown in FIG. 8 for terminals 160 of third variation NEMA 5-15R AC power outlet connector 122*c*.

Figure 10:
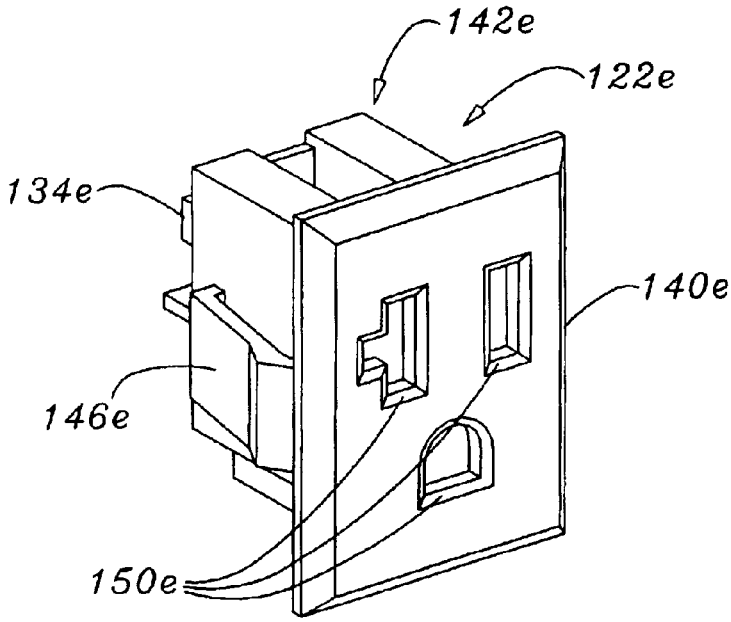
FIG. 10 is a front perspective view, similar to FIGS. 6A and 9, of a new NEMA 5-20R (125 VAC, 20 ampere) AC power outlet connector configured for installation in the 10 ampere IEC C13 cutout of FIG. 2, showing the standard 125, 20 ampere arrangement of the three pin receiving openings.

New NEMA 5-20R AC Power Outlet Connector of FIG. 10:

Shown in FIG. 10 is a new NEMA 5-20R AC power outlet connector (receptacle) 122*e*, in accordance with the present invention, that is rated for a 125 VAC, 20 ampere output, but that is configured for fitting closely into IEC C13 connector cutout 36 (FIG. 2) as may sometimes be desirable so the same enclosure 18 can be used.

New NEMA 5-20R AC power outlet connector 122*e* is also made having a shoulder portion 140*e* shaped and sized the same as shoulder portion 140 of new NEMA 5-15R power outlet connector 122 and a body portion 142*e* shaped and sized the same as body portion 142 (FIG. 6B) of the new NEMA 5-15R AC power outlet connector.

Thus, new NEMA 5-20R connector 122*e* may be identical to above-described new NEMA 5-15R connector 122 except for the standard 125 VAC, 20 ampere arrangement of three plug inlets 150*e* in body portion 142*e* for receiving a corresponding standard 5-20P plug (not shown) that is provided in place of the standard 125 VAC, 15 ampere arrangement (shown in FIG. 6A) of the three plug inlets 150 of new NEMA 5-15R AC power outlet connector 122.

Alternatively, body portion 142*e* of new NEMA 5-20R AC power outlet connector 122*e* may be shaped and sized in transverse cross section as depicted for body portion 142*a* of first variation NEMA 5-15R connector 122*a* (FIG. 7A) or as depicted for body portion 142*b* of second variation NEMA 5-15R connector 122*b* (FIG. 7B).

Body portion 142*e* of new NEMA 5-20R connector 122*e* is preferably formed having three flat, quick disconnect terminals as shown for terminals 134 of new NEMA 5-15R AC power outlet connector 122 in FIG. 6B, but may, according to circuit requirements, alternatively be formed having three pin terminals as shown, by way of example, for terminals 160 of third variation NEMA 5-15R AC power outlet connector 122*c* in FIG. 8.

Figure 11:
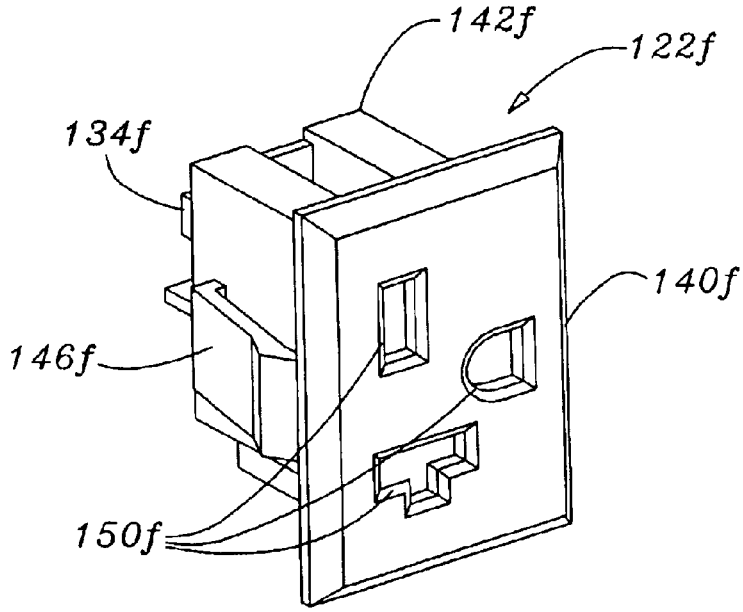
FIG. 11 is a front perspective view, similar to FIGS. 6A, 9 and 10, of a new NEMA 6-20R (250 VAC, 20 ampere) AC power outlet connector configured for installation in the 10 ampere IEC C13 cutout of FIG. 2, showing the standard 250 VAC, 20 ampere arrangement of the three pin receiving openings.

New NEMA 6-20R AC Power Outlet Connector of FIG. 11:

Shown in FIG. 11 is a new NEMA 6-20R AC power outlet connector (receptacle) 122*f*, in accordance with the present invention, that is rated for a 250 VAC, 20 ampere output, but that is configured for fitting closely into IEC C13 connector cutout 36 (FIG. 2) as may sometimes be desirable so the same enclosure 18 can be used.

New NEMA 6-20R AC power outlet connector 122*f* is also made having a shoulder portion 140*f* shaped and sized the same as shoulder portion 140 of new NEMA 5-15R power outlet connector 122 and a body portion 142*f* shaped and sized the same as body portion 142 (FIG. 6B) of the new NEMA 5-15R AC power outlet connector.

Thus, new NEMA 6-20R connector 122*f* may be identical to above-described new NEMA 5-15R connector 122 except for the standard 250 VAC, 20 ampere arrangement of three plug inlets 150*f* in body portion 142*f* for receiving a corresponding standard 6-20P plug (not shown) that is provided in place of the standard 125 VAC, 15 ampere arrangement (shown in FIG. 6A) of the three plug inlets 150 of new NEMA 5-15R AC power outlet connector 122.

Alternatively, body portion 142*f* of new NEMA 6-20R AC power outlet connector 122*f* may be shaped and sized in transverse cross section as depicted for body portion 142*a* of first variation NEMA 5-15R connector 122*a* (FIG. 7A) or as depicted for body portion 142*b* of second variation NEMA 5-15R connector 122*b* (FIG. 7B).

Body portion 142*f* of new NEMA 5-20R connector 122*f* is preferably formed having three spade terminals as shown for terminals 134 of new NEMA 5-15R AC power outlet connector 122 in FIG. 6B, but may alternatively be formed having three pin terminals as shown for terminals 160 of third variation NEMA 5-15R AC power outlet connector 122*c* in FIG. 8.

Both above-described new, 20 ampere NEMA 5-20R and 6-20R AC power outlet connectors 122*e* and 122*f* have respective body portions 142*e* and 142*f* configured for snapping into 10 ampere IEC C13 AC power outlet connector cutout 36. A benefit is achieved in that the same enclosure having IEC C13 cutouts 36 can be used not only for 10 ampere IEC C13 connector 22 and the above-described new 15 ampere NEMA 5-15R and 6-15R connectors 122–122*d*, but also for the new 20 ampere NEMA 5-20R and 6-20R AC power outlet connectors 122*e* and 122*f*. Different 15 ampere wiring harnesses 28 (FIG. 1) and 20 ampere wiring harnesses (not shown) will, however, normally be required for the respective 15 and 20 ampere AC power outlet connectors.

Figure 12:
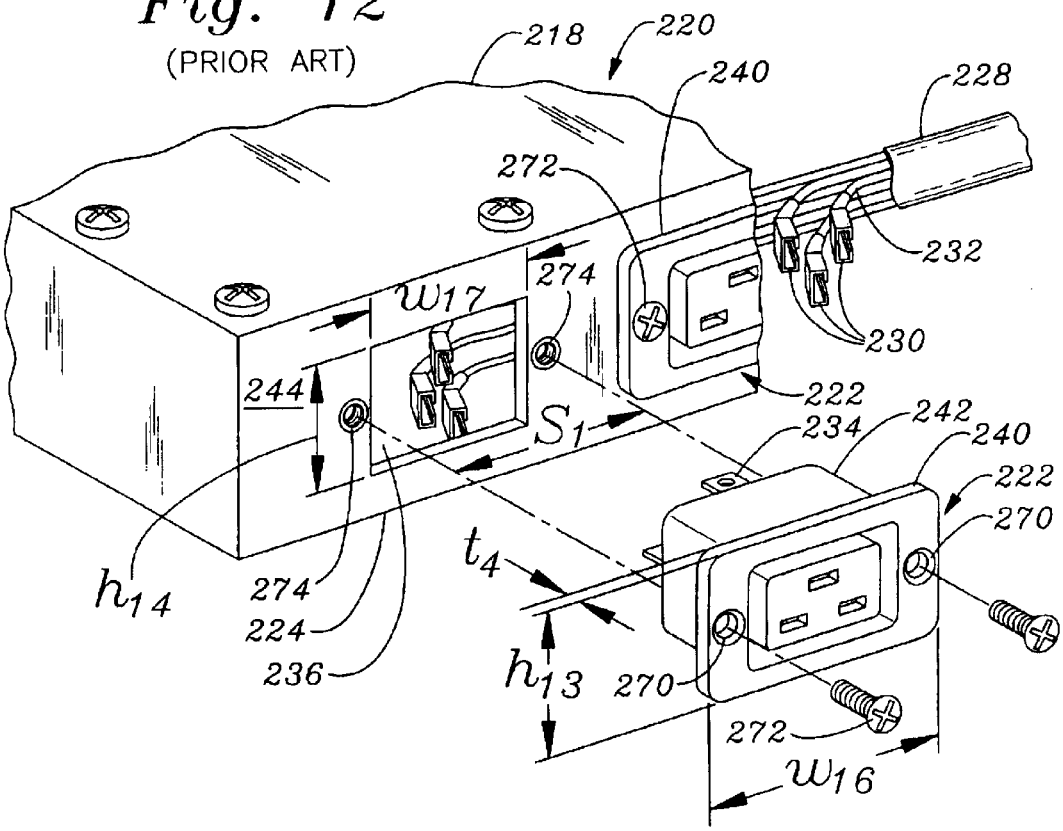
Fig. 12 (PRIOR ART)
FIG. 12 is a partial perspective drawing, similar to FIG. 1, depicting a representative second IEC-type AC power controller having a row of conventional screw-attached IEC C19 (250 VAC, 16 ampere) AC power outlet connectors front mounted in an enclosure wall, showing portions of an associated electrical wiring harness, showing an enclosure wall cutout for one of the IEC C19 AC power outlet connectors, and showing, in perspective, a front view of an uninstalled IEC C13 AC power outlet connector.

Preexisting 20 Ampere Electrical Equipment of FIGS. 12

FIG. 12 depicts a partial enclosure 218 of a representative, preexisting 16 ampere IEC-type AC power output controller 220 that corresponds generally to above-described 10 ampere AC power output controller 20 (FIG. 1). Representative AC power output controller 220 may, for example, comprise a model TPC 2105-2 AC power output controller manufactured by Pulizzi Engineering Inc. of Santa Ana, Calif.

As shown, enclosure 218 is constructed having a row of known (off-the-shelf) three pin, grounded female IEC type C19 (250 VAC, 16 ampere) AC power outlet connectors 222 (made of a hard, insulating thermoplastic material) front mounted in an enclosure wall 224. An associated connector wiring harness 228 (only portions of which are shown) is installed in enclosure 218 behind wall 224 adjacent inside regions of IEC outlet connectors 222. Sets of three end connectors 230 on wires 232 that comprise wiring harness 228 are provided for making slip-on electrical connection to corresponding flat terminals 234 (only one of which is shown) of each IEC C19 AC power outlet connector 222.

An uninstalled IEC C19 AC power outlet connector 222 is shown positioned for installation into a standard IEC C19 connector receiving cutout 236 in an enclosure wall 224. IEC C19 AC power outlet connector 222 comprises a shoulder or flange portion 240 and a body portion 242. Connector shoulder portion 240 is rectangular in outline with rounded corners and is sized to abut an exterior surface 244 of enclosure wall 224 when connector body portion 242 is received into cutout 236. Two opposing mounting holes 270 are formed in side regions of shoulder portion 240 for receiving ⅛ inch screws 272 which are threaded into inserts 274 in enclosure wall 224 adjacent each cutout 236. Shoulder portion 240 has a height, $h_{13}$, of about 1.34 inches, a width, $w_{16}$ of about 2.165 inches and a thickness, $t_4$, of about 0.12 inch. Connector body portion 242 is in transverse cross section rectangular with rounded corners.

Connector cutout 236 in enclosure wall 224 is sized to receive connector body portion 242 with about 0.02 inch total clearance and is rectangular in shape, having a height, $h_{14}$, of 1.180 inches and a width, $w_{17}$, of 1.490 inches. Screw inserts 274 are symmetrically located relative to cutout 236 and are centered apart a distance, $s_1$, of 1.772 inches.

Figure 13:
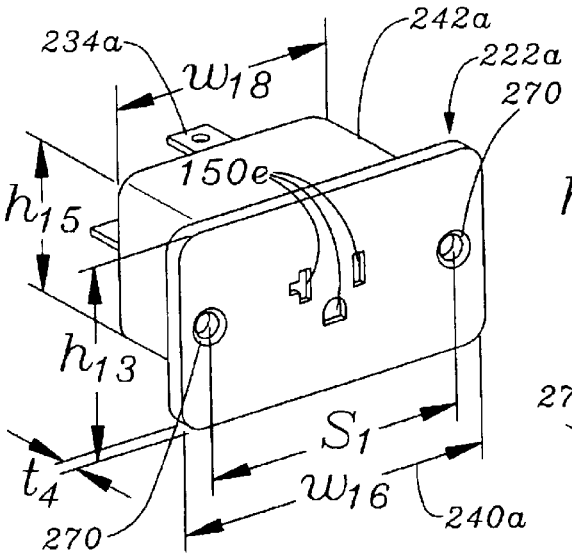
FIG. 13 is a front perspective view, corresponding generally to FIG. 10, of a new, screw-attached NEMA 5-20R (125 VAC, 20 ampere) AC power outlet connector configured similarly to IEC C19 AC power outlet connector of FIG. 12 for installation in the IEC C19 AC power outlet connector cutout, showing the standard 125 VAC, 20 ampere arrangement of the three pin receiving openings.

New NEMA 5-20R AC Power Outlet Connector of FIG. 13:

The present invention also encompasses new 20 ampere NEMA-type AC power outlet connectors which correspond directly to 16 ampere IEC C19 AC power outlet connectors used in 16 ampere power output equipment. A new, 125 VAC, 20 ampere NEMA 5-20R AC power outlet connector 222*a*, in accordance with the present invention, is depicted in FIG. 13. As shown, new NEMA 5-20R connector 222*a* is preferably formed having a shoulder portion 240*a* that is the same size and shape as described above for shoulder portion 240 of IEC C19 connector 222. Furthermore, new NEMA 5-20R connector 222*a* is preferably formed having a body portion 242*a* that is the same size and shape as described above for body portion 242 of IEC C19 connector 222. In that regard, body portion 242*a* has a height, $h_{15}$, that is about 1.160 inches and a width, $w_{18}$, that is about 1.470 inches, Also body portion 242*a* may include three flat quick disconnect terminals 234*a* (only one of which is shown) that may be arranged in the same pattern as terminals 234 of IEC C19 connector 222. Three plug-receiving inlet openings 150*e* are the same as described above for new NEMA 5-20R connector 122*e* (FIG. 10).

Figure 14:
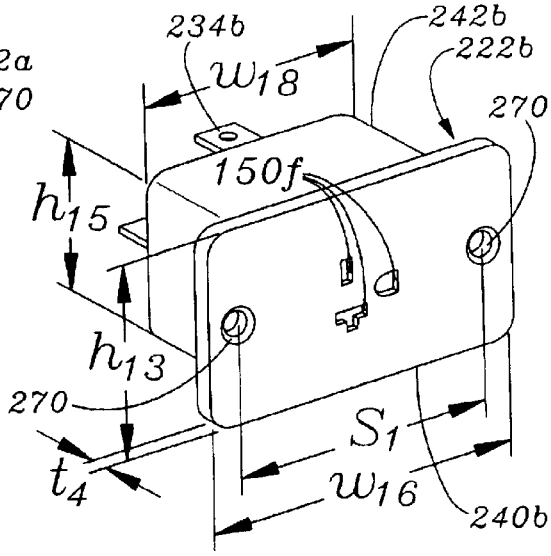
FIG. 14 is a front perspective view, corresponding generally to FIG. 11, of a new, screw-attached NEMA 6-20R (250 VAC, 20 ampere) AC power outlet connector configured similarly to IEC C19 AC power outlet connector of FIG. 12 for installation in the IEC C19 AC power outlet connector cutout, showing the standard 250 VAC, 20 ampere arrangement of the three pin receiving openings.

New NEMA 6-20R AC Power Outlet Connector of FIG. 14:

The present invention also encompasses new 20 ampere NEMA-type AC power outlet connectors which correspond directly to 16 ampere IEC-type AC power outlet connectors used in 16 ampere power output equipment. A new, 250 VAC, 20 ampere NEMA 6-20 R AC power outlet connector 222*b* in accordance with the present invention is depicted in FIG. 14. As shown, new NEMA 6-20R connector 222*b* is preferably formed having a shoulder portion 240*b* that is the same size and shape as described above for shoulder portion 240 of IEC C19 connector 222 (FIG. 12) and for shoulder portion 222*a* of new NEMA 5-20R connector 222*a* (FIG. 13). Furthermore, new NEMA 6-20R connector 222*b* is preferably formed having a body portion 242*b* that is the same size and shape as described above for body portion 242 of IEC C19 connector 222 and body portion 242*a* of new NEMA 5-20R connector 222*a*. Thus, as shown, body portion 242*b* has a height, $h_{15}$, that is about 1.160 inches and a width, $w_{18}$, that is about 1.470 inches, Also body portion 242*b* may include three flat disconnect terminals 234*b* (only one of which is shown) that may be arranged in the same pattern as terminals 234 of IEC C19 connector 222. Plug receiving inlet openings 150*e* are the same as described above for new NEMA 5-20R connector 122*e* (FIG. 10).

It will, of course, be understood that body portions 242*a* and 242*b* of new NEMA 5-20R and new NEMA 6-20R AC power outlet connectors 222*a* and 222*b*, respectively, may have different transverse cross sectional shapes so long as the body portions fit into IEC C19 connector cutout 236. Moreover connector body portions 242*a* and 242*b* of new NEMA 5-20R and new NEMA 6-20R AC power outlet connectors 222*a* and 222*b* may by provided having pin terminals, such as pin terminals 160 depicted, for example in FIG. 8, instead of flat quick disconnect terminals 234*a* and 234*b* (FIGS. 13 and 14). Moreover, body portions 242*a* and 242*b* of new NEMA 5-20R and new NEMA 6-20R AC power outlet connectors 222*a* and 222*b*, respectively, may be sized and shaped and have spring retaining clips similar to above-described clips 146*e* or 146*f* (FIGS. 10 and 11), to enable connectors 222*a* and 222*b* to be snapped into IEC C19 cutouts. In that case respective shoulder portions 240*a* and 240*b* of connectors 222*a* and 222*b* may be made without screw mounting holes 270 and may also be made smaller than described above.

As far as is known to the present inventors, conventional NEMA 6-15R, 5-20R and 6-20R AC power outlet connectors have been available only in joined pairs of (i.e., duplex) connectors, such as are used in wall outlets.

Figure 15:
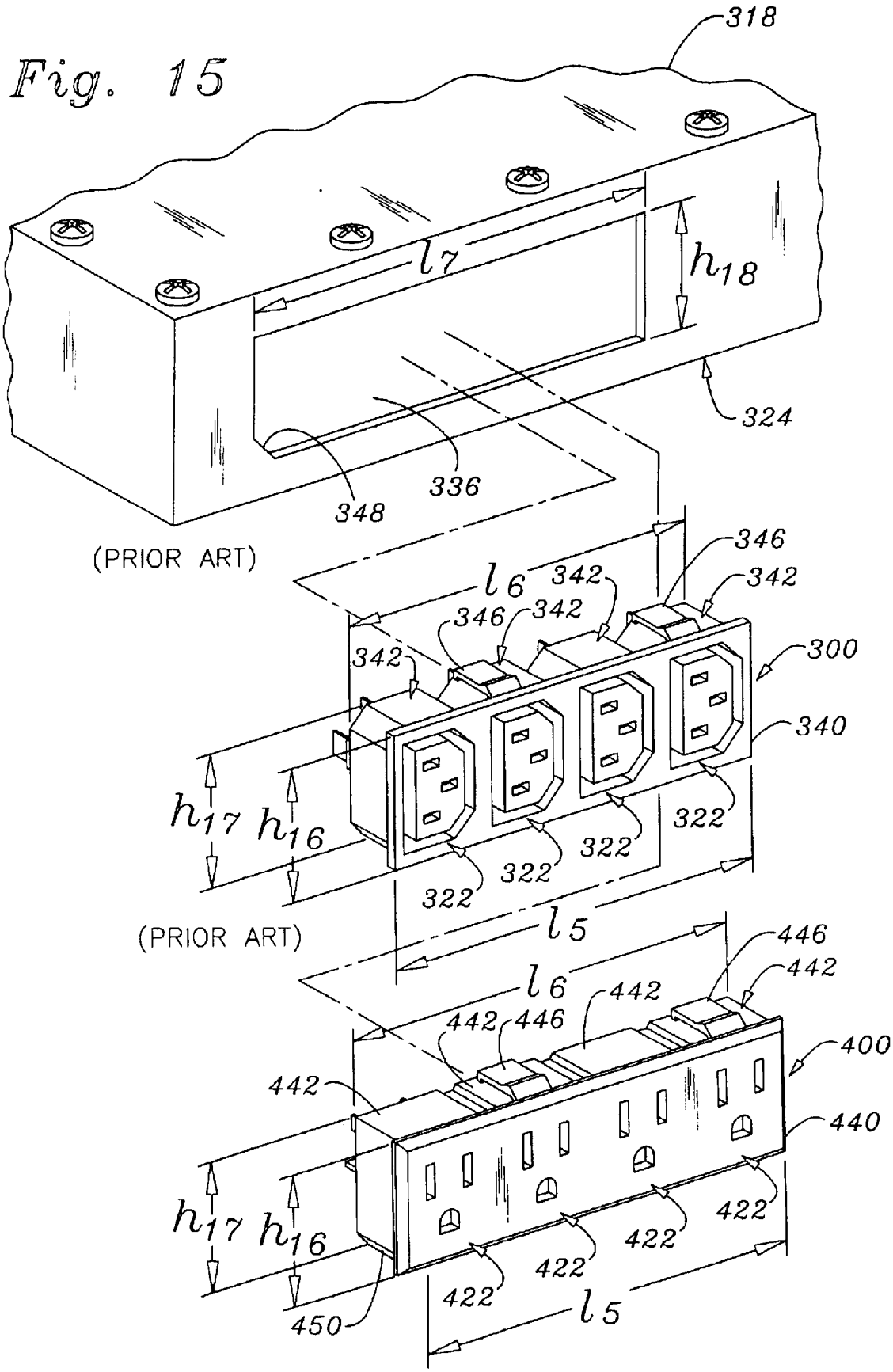
FIG. 15 is a perspective drawing of a representative, four IEC C13 AC power outlet connector snap-in module, showing an associated four connector module receiving cutout and further showing a representative new four NEMA 5-15R AC power outlet connector module for snapping into the IEC C13 module cutout.

Modular Arrangement of FIG. 15:

At least IEC type C13 AC power outlet connectors are available in a one piece modular or single block form with "n'=two to six such connectors formed in a side-by-side arrangement. In this regard, FIG. 15 depicts, by way of example, with no limitation being thereby intended or implied, an IEC C13 AC power outlet connector module 300 comprising "n"=four IEC C13 AC power outlet connectors 322 molded together into a single snap-in unit. Connectors 322 are identical to above-described IEC C13 AC power outlet connectors 22 (FIG. 1) except that instead of opposing pairs of spring retainer clips 46 on opposite sides of connector body portion 42 alternating ones of module connectors 322 are formed having opposing spring retainer clips 346 at the top (as shown) and bottom (not shown) of connector body portions 342.

As shown, a composite connector module shoulder portion 340 has a height, $h_{16}$, of 1.428 inches and an overall modular length, $l_5$ of 4.041 inches. Each connector body portion 342 has a height, $h_{17}$, of 1.220 inches and together the body portions have a combined length, $l_6$, of 3.918 inches. A corresponding cutout 336 in wall 324 of enclosure 318 for receiving IEC C13 AC power outlet connector module 300 has a height, $h_{18}$, of 1.326 inches and a length, $l_7$, of 3.939 inches. Preferably as shown in FIG. 15, but not necessarily, cutout 336 is beveled at about 45 degrees at one corner region, for example, a lower left-hand corner region 348, to ensure a predetermined orientation of connector module 300 upon its installation in the cutout. The bevel at representative corner 348 may be sized as shown at corner 48 of cutout 36 (FIG. 2).

Dimensions $l_5$, $l_6$ and $l_7$ in inches for corresponding IEC C13 AC power outlet connector modules comprising other side-by-side arrangements of 2, 3, 5 and 6 (not shown) IEC C13 connectors 322 are shown below in Table I.

TABLE I

| "n" connectors | $l_5$ | $l_6$ | $l_7$ |
|---|---|---|---|
| 2 | 2.081 | 1.959 | 1.980 |
| 3 | 3.061 | 2.939 | 2.959 |
| 5 | 5.020 | 4.898 | 4.918 |
| 6 | 6.000 | 5.878 | 5.898 |

Also shown in FIG. 15 is a one piece new NEMA AC power outlet connector substitute module 400 which comprises, again by way of illustrative example, 4 new NEMA 5-15R AC power outlet connectors 422 molded together into a single snap-in unit that is shaped and sized to be snapped into above-described receiving cutout 336 in place of IEC C13 AC power outlet connector module 300.

Connectors 422 are preferably identical to above-described new NEMA 5-15R AC power outlet connectors 122 (FIG. 3) except that instead of opposing pairs of spring retainer clips 146 on opposite sides of connector body portion 142 alternating ones of module connectors 422 are formed having opposing spring retainer clips 446 at the top (as shown) and bottom (not shown) of connector body portions 442. A lower corner 450 of the first-in-line one of connectors 422 is beveled to match the bevel at cutout corner 348 to enable the fitting of new NEMA module 400 in cutout 336 and to provide for correct module orientation in the cutout.

Since new NEMA 5-15R AC power outlet connector module 400 is intended to be installed in receiving cutout 336 in place of IEC C13 AC power outlet connector module 300, overall dimensions of new NEMA 5-15R connector module 400 are the same as those of above-described IEC 13C connector module 300. Accordingly, TABLE I also applies to other new NEMA 5-15R connector modules formed of 2, 3, 5 and 6 connectors 422.

Although FIG. 15 depicts new NEMA 5-15R AC power outlet connector module 400, it is to be understood that corresponding new NEMA connector modules of any mentioned sizes and formed from any of the above-described new NEMA 6-15R, 5-20R and 6-20R AC power outlet connectors, as well as all above disclosed and other variations thereof, are within the scope of the present invention.

For some equipment, it may be required or desired to provide a connector substitute module (not shown) corresponding to above-described new NEMA connector substitute module 400 that includes both new NEMA AC power outlet connectors 422 and IEC AC power outlet connectors 322. In such cases, considering that the original IEC connector module 300 to be replaced is formed having "n" IEC connectors 322, then, in the substitute combination new NEMA and IEC connector module, the number of new NEMA connectors 422 would be equal to the number "m" and the number of IEC connectors 322 would be equal to the difference "n−m". For example if a connector substitute module replacing an existing IEC connector module having 6 IEC connectors 322 (i.e., n=6) is required to have 4 new NEMA connectors 422 (i.e., "m"=4) then 2 IEC connectors 322 (i.e., "n−m"=6−4=2) would be included in the substitute module corresponding to new module 400.

It is thus apparent that in above-described connector substitute module 400 the number "m" of new NEMA connectors 422 is equal to the number "n" of IEC connectors 322 in module 300 being replaced, and there are zero IEC connectors 322 in the substitute module. In a more general sense, the number "m" of new NEMA AC power outlet connectors 422 in a connector substitute module corresponding to substitute module 400 may be between 1 and "n".

All new NEMA AC power outlet connectors and connector modules described above are preferably made to securely fit into an enclosure wall having a thickness between about 0.04 inch and about 0.07 inch.

Although there have been described above new female NEMA-style AC power outlet connectors, and several variations thereof and also including a modular arrangement thereof, in accordance with the present invention for purposes of illustrating the manner in which the present invention maybe used to advantage, it is to be understood that the invention is not limited thereto. Consequently, any and all variations and/or equivalent arrangements which may occur to those skilled in the applicable art are to be considered to be within the scope and spirit of the invention as set forth in the claims which are appended hereto as part of this application.

What is claimed is:

1. A method of constructing electrical equipment, said method comprising the steps of:

a. providing an electrical equipment enclosure having side walls, at least one of said side walls having an IEC AC power outlet connector cutout;

b. installing an IEC/NEMA AC power outlet connector electrical wiring harness in said equipment enclosure adjacent said IEC AC power outlet connector cutout;

c. constructing a new NEMA-type AC power outlet connector sized to fit closely into said IEC AC power outlet connector cutout:

d. installing said new NEMA-type AC power outlet connector into said IEC AC power outlet connector cutout; and e. connecting said electrical wiring harness to said new NEMA-type AC power outlet connector.

2. The method as claimed in claim 1, wherein the step of providing an electrical equipment enclosure includes configuring said IEC AC power outlet connector cutout for a type IEC C13, 250VAC, 10 ampere power outlet connector.

3. The method as claimed in claim 2, wherein the step of forming a new NEMA-type AC power outlet connector includes forming a new NEMA-type AC power outlet connector selected from the group consisting of NEMA-type 5-15R, 125 VAC, 15 ampere; NEMA-type 6-15R, 250 VAC, 15 ampere; NEMA-type 5-20R, 125 VAC, 20 ampere; and NEMA-type 6-20R, 250 VAC, 20 ampere AC power outlet connectors.

4. The method as claimed in claim 1, wherein the step of providing an electrical equipment enclosure includes configuring said IEC AC power outlet connector cutout for a type IEC C19, 250 VAC, 16 ampere AC power outlet connector.

5. The method as claimed in claim 4, wherein the step of forming a new NEMA-type AC power outlet connector includes forming a new NEMA-type AC power outlet connector selected from the group consisting of NEMA-type 5-20R, 125 VAC, 20 ampere and NEMA-type 6-20R, 250 VAC, 20 ampere AC power outlet connectors.

* * * * *